US005978988A

United States Patent [19]

Burchett

[11] Patent Number: 5,978,988

[45] Date of Patent: Nov. 9, 1999

[54] FRAME FOR PIVOTING FOLDING FURNITURE HAVING VARYING COUNTERBALANCING TORQUE VALUES

[75] Inventor: Dale D. Burchett, Louisville, Ky.

[73] Assignee: C.A.B., Inc., Louisville, Ky.

[21] Appl. No.: 08/993,032

[22] Filed: Dec. 18, 1997

[51] Int. Cl.[6] ..... A47C 19/12

[52] U.S. Cl. ..... 5/136; 5/133; 5/159.1; 5/164.1

[58] Field of Search ..... 5/133, 136, 159.1, 5/160, 164.1, 167

[56] References Cited

U.S. PATENT DOCUMENTS

| | | | |
|---|---|---|---|
| 158,986 | 1/1875 | Schwartz et al. . | |
| 354,729 | 12/1886 | Montgomery . | |
| 380,258 | 3/1888 | Herrinton | 5/164.1 |
| 416,010 | 11/1889 | Osgood . | |
| 483,724 | 10/1892 | Noyes . | |
| 554,653 | 2/1896 | Christ | 5/164.1 X |
| 598,841 | 2/1898 | Barton . | |
| 640,965 | 1/1900 | Songer . | |
| 1,059,497 | 4/1913 | Smith et al. | 5/164.1 |
| 1,724,066 | 8/1929 | Bean . | |
| 2,504,769 | 4/1950 | Walter . | |
| 2,534,300 | 12/1950 | Schorn . | |
| 2,672,624 | 3/1954 | Giuseffi . | |
| 3,046,572 | 7/1962 | Eames et al. . | |
| 3,088,127 | 5/1963 | Eames . | |
| 3,097,369 | 7/1963 | Emch . | |
| 3,116,494 | 1/1964 | Bennett et al. . | |
| 3,464,070 | 9/1969 | Driver . | |
| 3,877,086 | 4/1975 | Bue et al. . | |
| 3,999,245 | 12/1976 | Bue et al. . | |
| 4,370,766 | 2/1983 | Teague | 5/133 |
| 4,589,152 | 5/1986 | Pakosh | 5/136 X |
| 4,736,476 | 4/1988 | Maquerra . | |
| 4,793,011 | 12/1988 | Eve . | |
| 5,033,134 | 7/1991 | Burchett . | |
| 5,081,724 | 1/1992 | Takahashi et al. | 5/136 |
| 5,353,452 | 10/1994 | Rulis . | |

FOREIGN PATENT DOCUMENTS

| | | |
|---|---|---|
| 594871 | 11/1947 | United Kingdom . |

*Primary Examiner*—Terry Lee Melius
*Assistant Examiner*—Robert G. Santos
*Attorney, Agent, or Firm*—Wheat, Smith & Beres, PLC; Vance A. Smith; David W. Nagle, Jr.

[57] ABSTRACT

A folding furniture apparatus for selectively and alternatively moving a pivotally connected furniture component between a substantially horizontal usable position and a substantially vertical storage position includes a counterbalancing piston assembly and associated mounting hardware that can provide one of a selected value of torques, counterbalancing the weight of furniture component. At least one counterbalancing piston extends between an upper mounting bracket secured to a support assembly and a lower bracket secured to the furniture component, each of these brackets having a plurality of corresponding mounting points. A counterbalancing piston is pivotally secured to and extends from a selected mounting point on the lower bracket to an associated mounting point on the upper bracket. The lower amounting points and associated upper mounting points are preselected to provide the necessary counterbalancing (torque) for a certain weight of the furniture component without requiring the use of a different piston or relocation of the mounting hardware.

6 Claims, 7 Drawing Sheets

FRAME FOR PIVOTING FOLDING FURNITURE HAVING VARYING COUNTERBALANCING TORQUE VALUES

The present invention relates to folding furniture assemblies and, more specifically, to folding furniture assemblies that have pivoting structures permitting a user contacting portion to be pivoted between a substantially vertical storage position and a substantially horizontal use position.

Folding furniture assemblies are well known in the prior art and are commonly used where available space within the area of use is limited. Such furniture folding assemblies are provided with a rotation system that allows for the pivoting of the "user contacting portion", i.e., a supporting frame and cushion/mattress components, between a storage position and user position. Typically the storage position is substantially vertical and the assembly is housed in a decorative cabinet. Similarly, the user position is substantially horizontal, allowing the user to sit or lie on the cushion/or mattress kept in position by the supporting frame. Because the combined weight of the elements that make up the user contacting portion can be considerable, counterbalancing mechanisms are frequently employed that allow an individual to easily raise the user contacting portion to the upright storage position.

Various counterbalancing mechanisms have been developed for such furniture, including spring systems, counterbalancing hinges, and piston-based arrangements. Piston-based arrangements have proven to be an especially effective in heavier applications, such in the counterbalancing the weight of a bed, typically the frame, mattress, and box springs. An example of the piston-based arrangement is set forth in U.S. Pat. No. 5,033,134 issued tc the same inventor as this application. As described therein and typical with piston-based counterbalancing, a pair of gas filled counterbalance pistons, providing an appropriate resistive force to the downward acting gravitational force acting on the bed frame and the mattress, are respectively secured to the inside surfaces of the wall mounted cabinet (housing the frame/mattress when stored vertically) and to the sides of the bed frame. The pistons are biased to resist, i.e., counterbalance, the downward force of gravity acting on the user contacting components, thus assisting in both the lowering of the components to the use position and lifting/returning of the components to the storage position.

To properly counterbalance the weight of the user contacting components (the "component weight"), a piston exerting an appropriate counterbalancing force and the location of the structure serving as the attachments for the piston ends must be carefully selected. While a number of variables must be considered, the component weight is the primary factor in making the proper selection. Varying the component weight such as when using different materials for the bed frame, changing the size of the mattress, or adding/subtracting a box spring complicates the selection of the piston and piston end mounting locations. For example, the substitution of a particle board material for lighter board material for the bed frame is likely to require the use of heavier piston with greater resistive counterbalancing force and/or change in positioning of the hardware plates serving as attachments for the piston ends. Such changes in the piston and hardware are both time consuming and expensive, and may prove extremely impractical to the user who innocently changes the component weight.

It is a paramount object of the present invention to provide for a folding furniture assembly that facilitates significant variations in the component weight of the assembly without the necessity of changing the counterbalancing force components. Still another important object is to provide attachment hardware for a folding furniture assembly using piston based counterbalancing force components that can alter the counterbalancing force as the component weight changes without repositioning of the attachment hardware. These and other objects of the present invention will become clear upon a reading of the description below accompanied by the appended drawings.

SUMMARY

The present invention pertains to a folding furniture apparatus for selectively and alternatively moving between a substantially horizontal usable position and substantially vertical storage position. The apparatus generally comprises a support assembly, a furniture component, and a counter balancing mechanism. The furniture component is pivotally connected about a pivot axis to the support assembly for movement between a usable position and a storage positions. The counterbalancing system creates one of a selected value of torques about the pivot point and biases the component to the vertical position. In a preferred embodiment of the present invention, the furniture apparatus is a folding bed that can be selectively and alternatively moved from a substantially vertical storage position to a substantially horizontal usable position. The folding bed has a support assembly for housing the bed when in the storage position, a bed frame for supporting a bed mattress and other bed paraphernalia. The bed frame is pivotally connected about a pivot axis to the support assembly. The folding bed also has at least one upper mounting bracket mounted to the bed frame near the pivot axis and at least one lower mounting bracket mounted to the support assembly. The lower bracket has a plurality of first mounting points and the upper bracket has an associated plurality of second mounting points wherein each of the first mounting points is separated from an associated mounting point by essentially the same distance. The bed assembly has at least one counterbalancing assembly for creating a torque acting on the bed frame toward the storage position. The counter balancing assembly is pivotally and removably connected at one end at a selected one of to the mounting points on the upper mounting bracket and pivotally and removably connected at the other end at a mounting point of the upper bracket associated with the selected mounting point. This connection allows the counterbalancing assembly to be repositioned between the mounting points and the associated mounting points to vary the counterbalancing torque acting on the bed frame.

DETAILED DESCRIPTION OF THE PREFERRED EMBODIMENT

Figure 1:
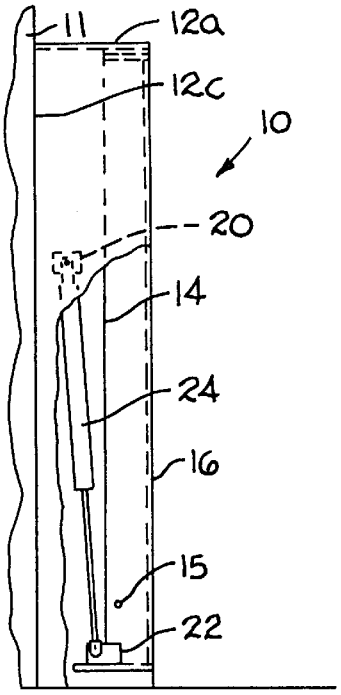
PRIOR ART FIG. 1
FIG. 1 is a side view of a typical folding bed assembly, wherein the bed is in a stored or vertical position.

Reference is initially made to FIGS. 1–4, illustrating the components of a typical prior art folding bed structure shown generally by the character numeral 10. The structure 10 comprises a housing or cabinet 12 in an essentially upright position secured to or mounted against a wall 11 and a bed frame 14 pivotally attached to the cabinet 12 and adapted to receive a user contacting portion such as a mattress 16. A pivoting foot element 14*g* provides support for the bed frame 14 when in a horizontal position.

Figure 3:
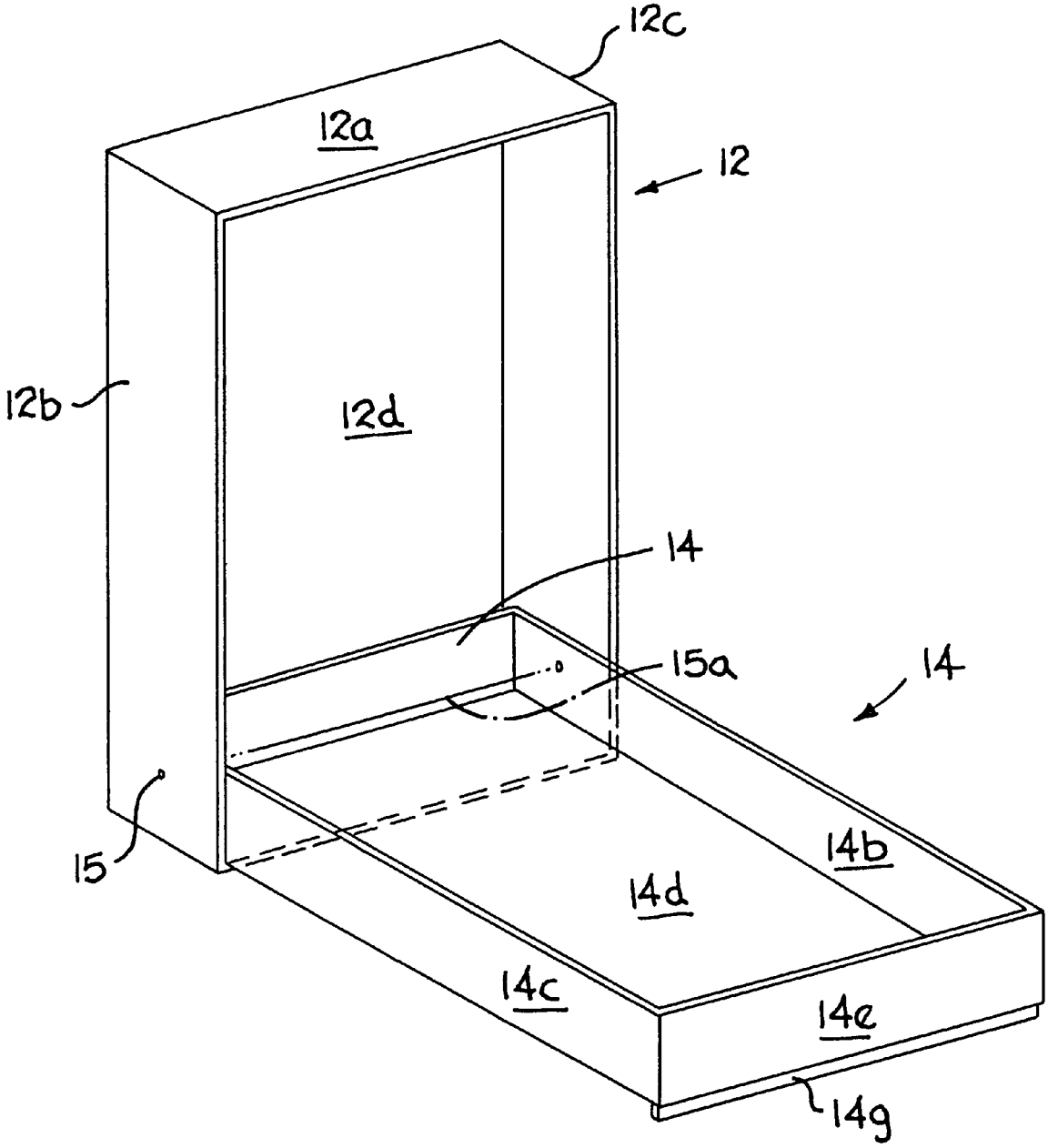
PRIOR ART FIG. 3
FIG. 3 is a perspective view of the cabinet and the bed frame when in the horizontal position.

As best seen in the perspective of FIG. 3, the cabinet 12 is generally comprised of a top 12*a*, two sides 12*b* and 12*c*, and a back 12*c* which form a cabinet of sufficient height and depth to accommodate and enclose the furniture piece which, in this instance, is the bed frame 14 and a mattress 16. Bed frame 14 comprises a front rail 14*a*, a pair of side rails 14*b* and 14*c*, a base 14*d*, and a foot rail 14*e* that collectively define an open, rectangular box for receiving the mattress 16. The pivoting foot element 14*g* may be attached as desired to the foot rail 14*e* and pivoted out as the bed frame 14 is lowered. The side rails 14*b* and 14*c* are pivotally mounted, respectively, to the inside surfaces of the sides 12*a* and 12*b* of cabinet 12 by any conventional pivoting mechanism. For purposes of clarity only the pivot point 15 and pivot axis 15*a* are shown.

Figure 4:
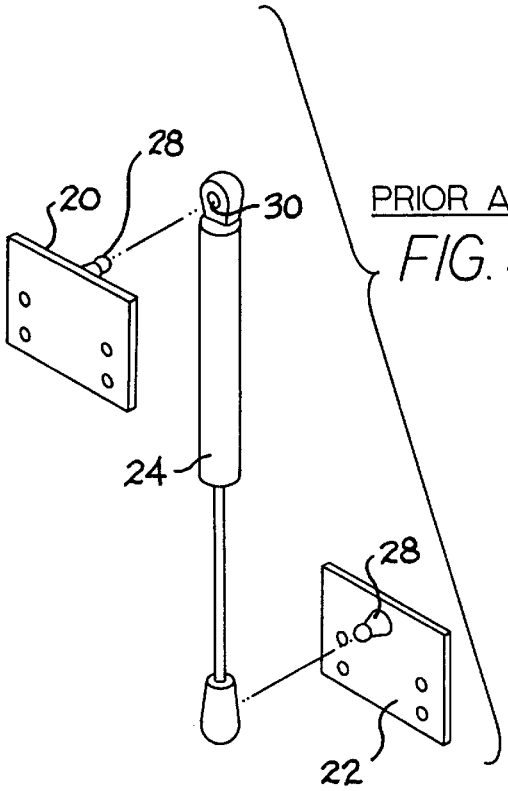
PRIOR ART FIG. 4
FIG. 4 is a perspective view of a typical folding piston and hardware attachment structure used with a folding bed assembly of FIGS. 1 and 2.
Figure 2:
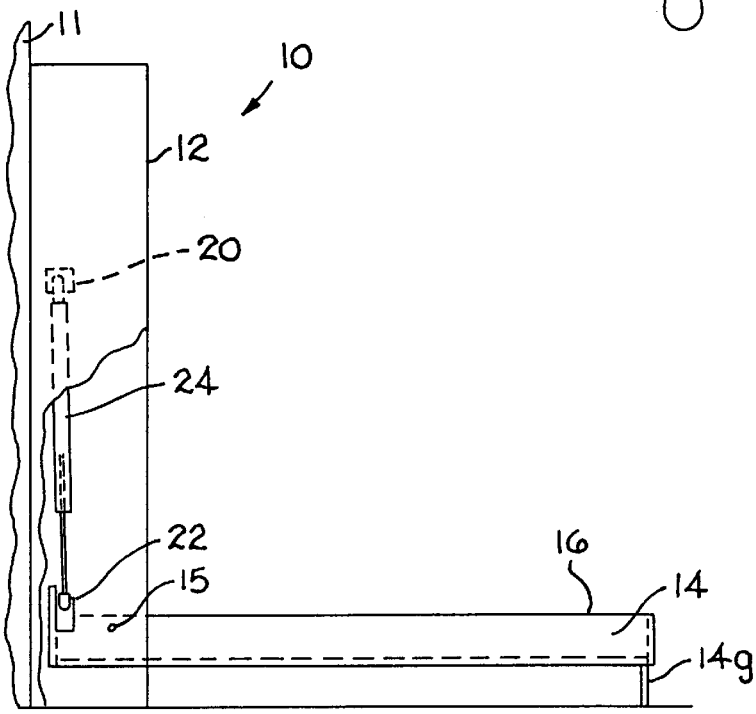
PRIOR ART FIG. 2
FIG. 2 is a side view of a typical folding bed assembly, wherein the bed is in a user or horizontal position.

Referring now to FIGS. 1, 2 and 4, it may be seen that the counterweight mechanism that assists the user in lowering and raising the bed comprises (1) a first pair of mounting brackets 20 attached to an upper region of the inner surfaces of the sides 12*b* and 12*c* of the cabinet 12, (2) a second pair of mounting brackets 22 attached to the outer surfaces of the side rails 14*b* and 14*c* of the frame 14 near the pivot point 15 but closer to the back side 12*d* of cabinet 12, and (3) a pair of pistons 24 secured at one end to the brackets 20 near the pivot point and at the other end to the brackets 22. The back or bottom side (not shown) of the base is typically a tastefully decorated surface that provides a complimentary look to the support assembly when the bed frame 14 is folded or in its upright position within the assembly 12. Pistons 24 may be conventional gas operated pistons.

The perspective of FIG. 4 shows a first pair and second pair of conventional mounting brackets 20 and 22 for the counterweight pistons 24 used in the prior art folding bed assemblies 10. Generally, the prior art brackets 20 and 22 are flat plates each of which define a plurality of holes 26 for receiving wood screws (not shown). The brackets 20 and 22 are secured, respectively, to the sides 12*b*, 12*c* of the support assembly 12 and to the side rails 14*b*, 14*c* of the bed frame 14. Extending from each bracket 20 and 22 is a ball-mounting element 28 that mates with a ball-receiving recess 30 defined in each end of the pistons 24. The pistons 24 therefore are pivotally mounted to the sides 12*a*, 12*b* and to the side rails 14*a* and 14*b*. The pistons 24 become compressed as the bed frame 14 is lowered, thus resisting the force of gravity acting on the bed frame 14 and assisting the user in rotating the bed frame from the horizontal into its vertical position within cabinet 12. All of these features are fully described in U.S. Patent issued to Burchett which is incorporated herein by reference.

Figure 5:
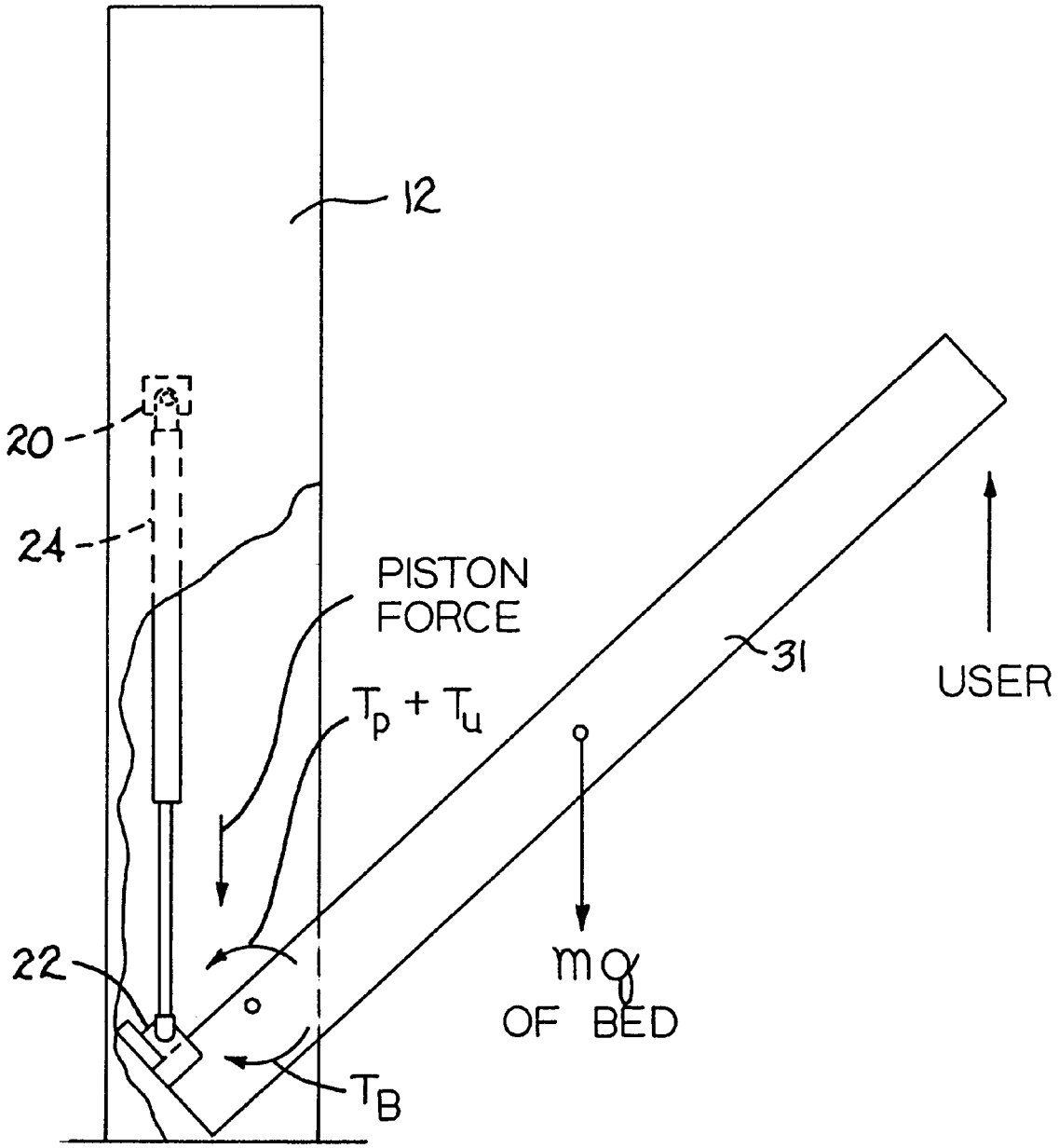
FIG. 5 is a side view of a folding bed assembly showing the various forces and torques acting upon the bed frame and mattress components.

FIG. 5 indicates the forces and torques that are involved in raising the bed frame 14/mattress 16, referred collectively as the bed and indicated generally by character numeral 31, from a horizontal position to a vertical position within the cabinet 12. As indicated, the weight of the bed 31 creates a clockwise torque $T_B$ around the bed's pivot axis 15*a*. To raise the bed 31, a user must overcome this torque $T_B$ by creating a counterclockwise torque slightly greater than $T_B$ about the pivot axis 15*a*. The pistons 24 provide a downwardly acting force that creates a counterclockwise torque $T_P$ about the pivot axis 15*a* approximate in magnitude to the torque $T_B$. Thus, the user need supply only a small or nominal counterclockwise torque to overcome the torque $T_B$ and raise the bed 31 to a vertical position.

Figure 6:
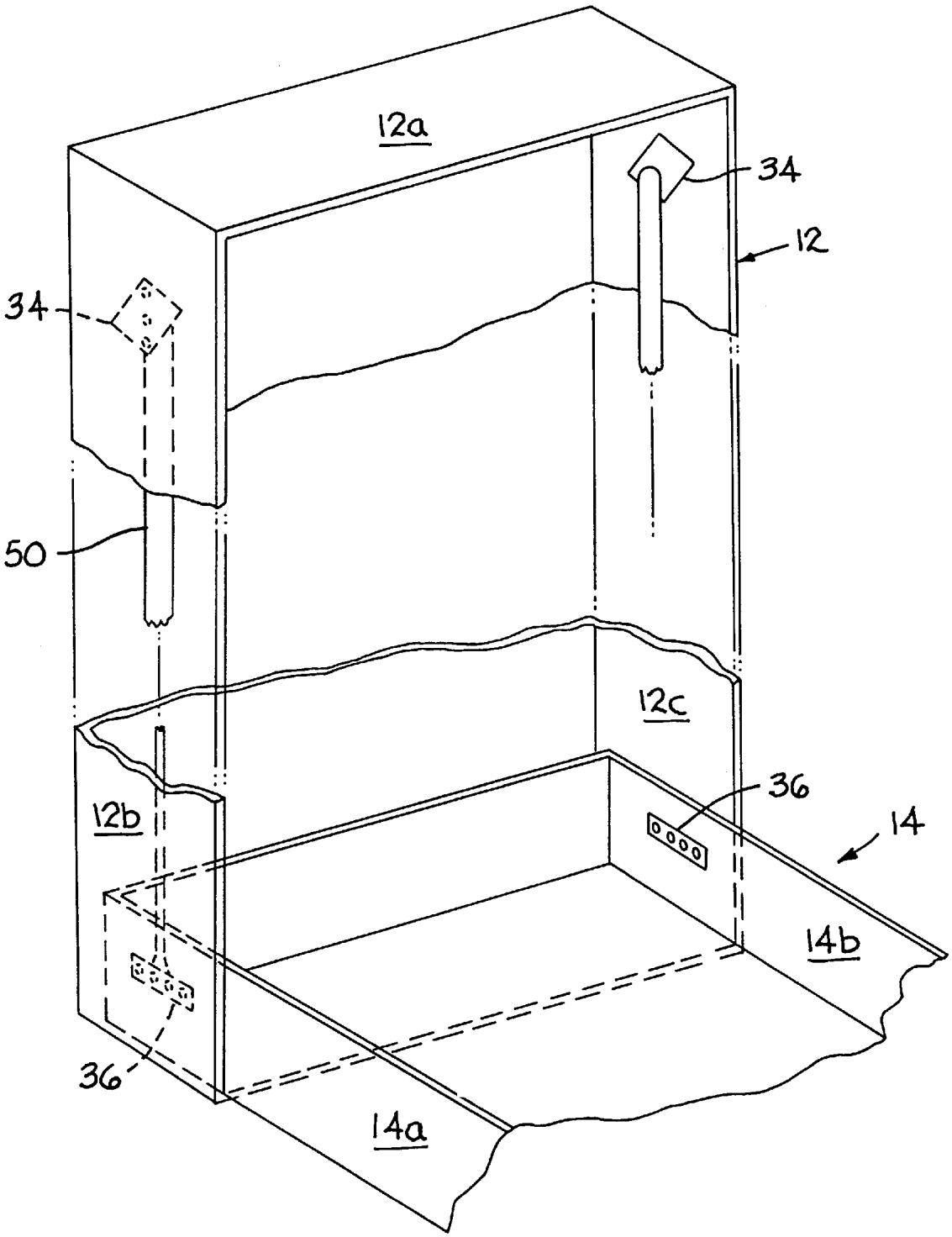
FIG. 6 is a perspective view of a folding bed assembly in accordance with the present invention, partially broken away, showing the relationship of the piston attachment hardware when the bed frame is a horizontal position.
Figure 7:
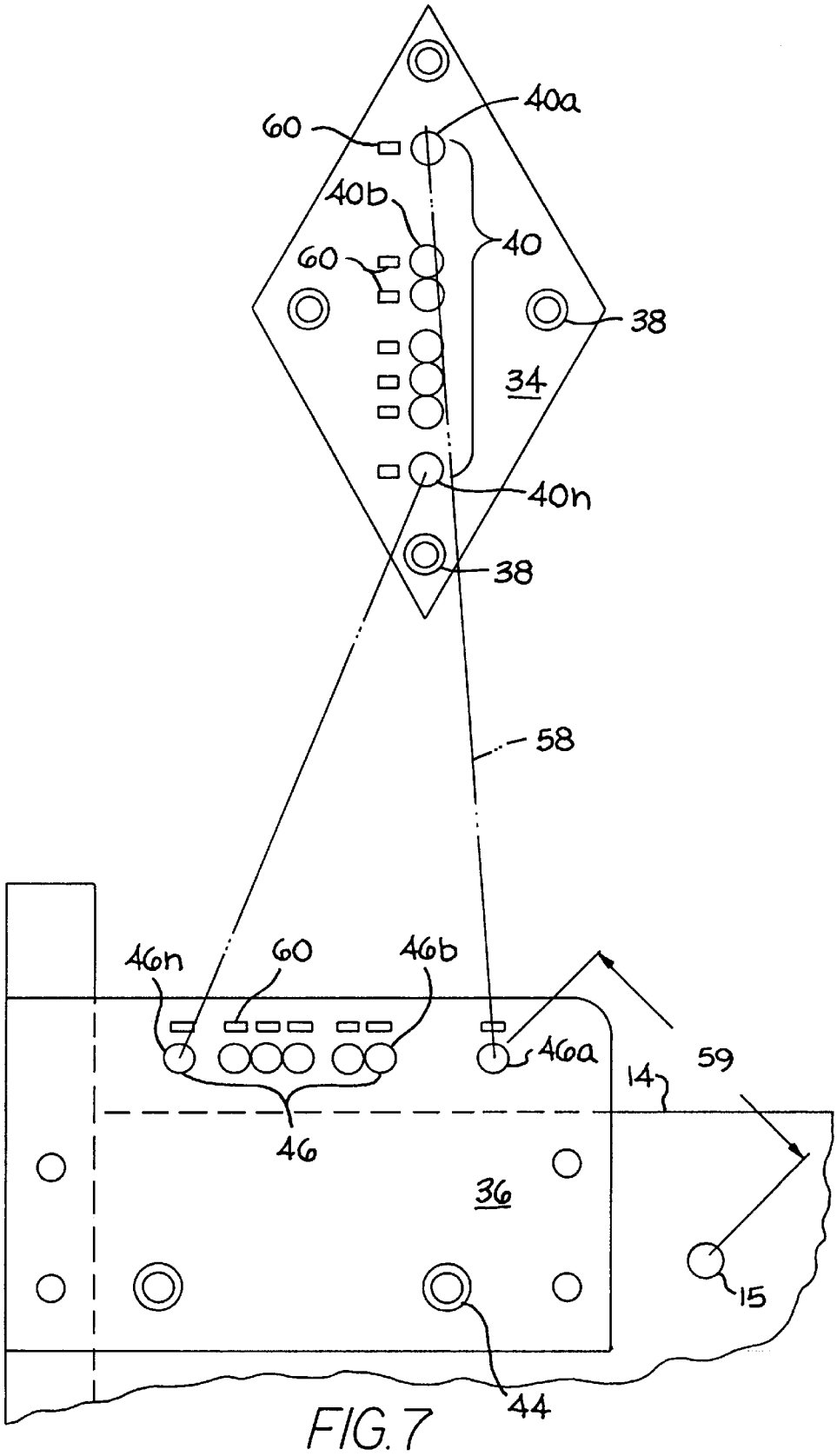
FIG. 7 is a side view of the piston attachment hardware constructed in accordance with the present invention.
Figure 8:
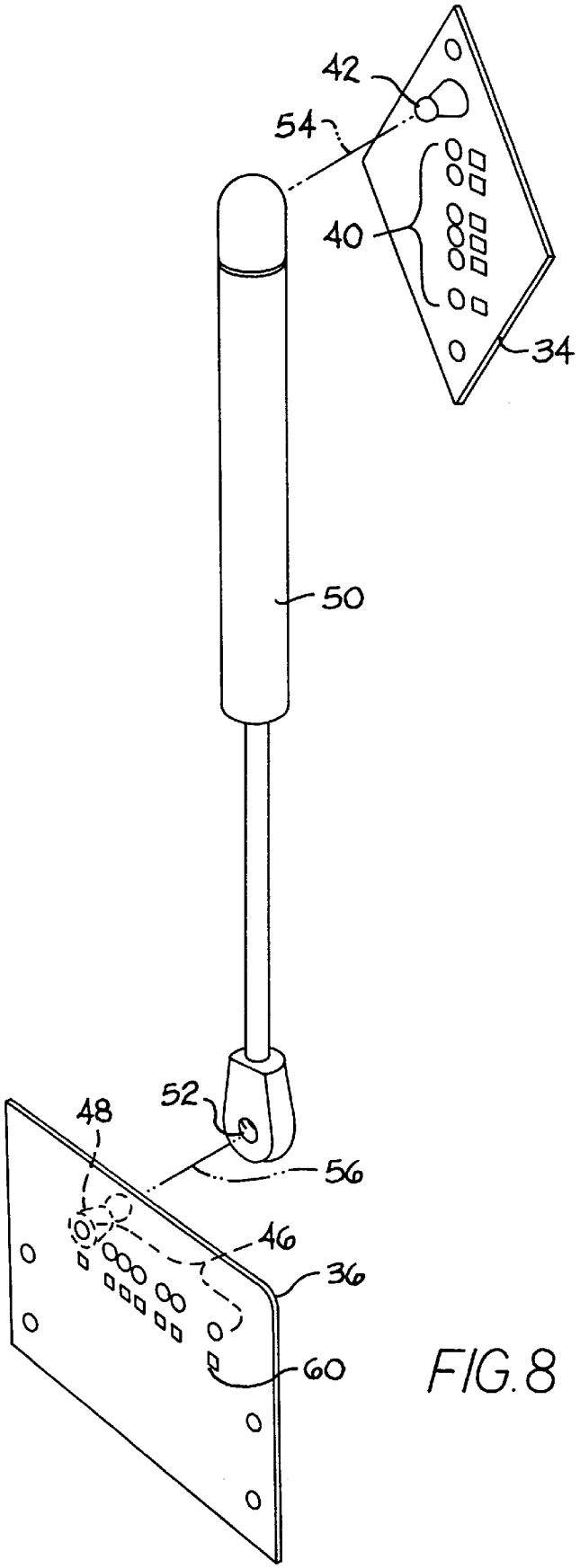
FIG. 8 is a perspective view of the piston and piston attachment hardware constructed in accordance with the present invention.

The present invention is best described in reference to FIGS. 6, 7, and 8 in which mounting brackets 34 and 36 replace the respective prior art mounting brackets 20 and 22. Mounting brackets 34 are preferably metal plates having a plurality of openings 38 allowing the brackets 34 to be secured to the inside surfaces of sides 12*b* and 12*c*. The shape of the brackets 34 permit an array of openings 40 oriented substantially vertical along a major axis of the brackets 34. A removably mounted ball element 42 can be screwed into a selected one of the openings as best illustrated by FIG. 8.

Lower brackets 36 are similarly constructed of a metal plate and have preferably a generally rectangular shape. Brackets 36 are mounted by screws (not shown) projecting through holes 44 into the inside surfaces of side rails 14*b* and 14*c* of the bed frame 14. A second array of openings 46 are aligned substantially horizontal along a major axis of brackets 36. As with bracket 34, a removable ball element 48 is removably screwed into a selected one of the openings 46. Counterbalance pistons 50 are then attached between brackets 34 and 36. As perhaps best seen in FIG. 8, pistons 50 have ends thereof with complimentary ball-receiving openings 52 adapted to snap fit over the ball elements 42 and 48, creating a ball and socket joint and allowing the pistons 50 to rotate relative to the brackets 34 and 36 about respective axis 54 and 56.

Referring again to FIG. 7, it should be understood that the lengths of the lines between associated holes 40 and 46 are not to scale and was made to show the vertical and horizontal alignments. The vertically aligned holes 40 of the upper bracket 34 and the horizontally aligned holes 46 of the lower bracket 36 are spaced such that the distance between the hole 40*a* and 46*a* is the same as the distance between hole 40*b* and 46*b*. In other words, the distance between corresponding holes 40 and 46 remains constant. Thus, the same piston 50 may be mounted between any two mounting elements secured in corresponding holes 40*n* and 46*n*.

Because the distance 59 between the pivot point 15 and the pivot attachment of piston 50 to the mounting plate 36 can be varied by relocating the mounting element 48 to a selected opening 46, the torque exerted by the piston 50 can be varied. The torque $T_P$ becomes greater as the distance 59 is increased. Thus, for example, when greater torque is needed, the pistons 50 are removed, the mounting elements 42 and 48 relocated from holes 40*a* and 46*a* to holes 40*b* and 46*b*, respectively, and the piston 50 reattached. In this instance, greater torque is obtained while using the same piston 50.

Figure 9:
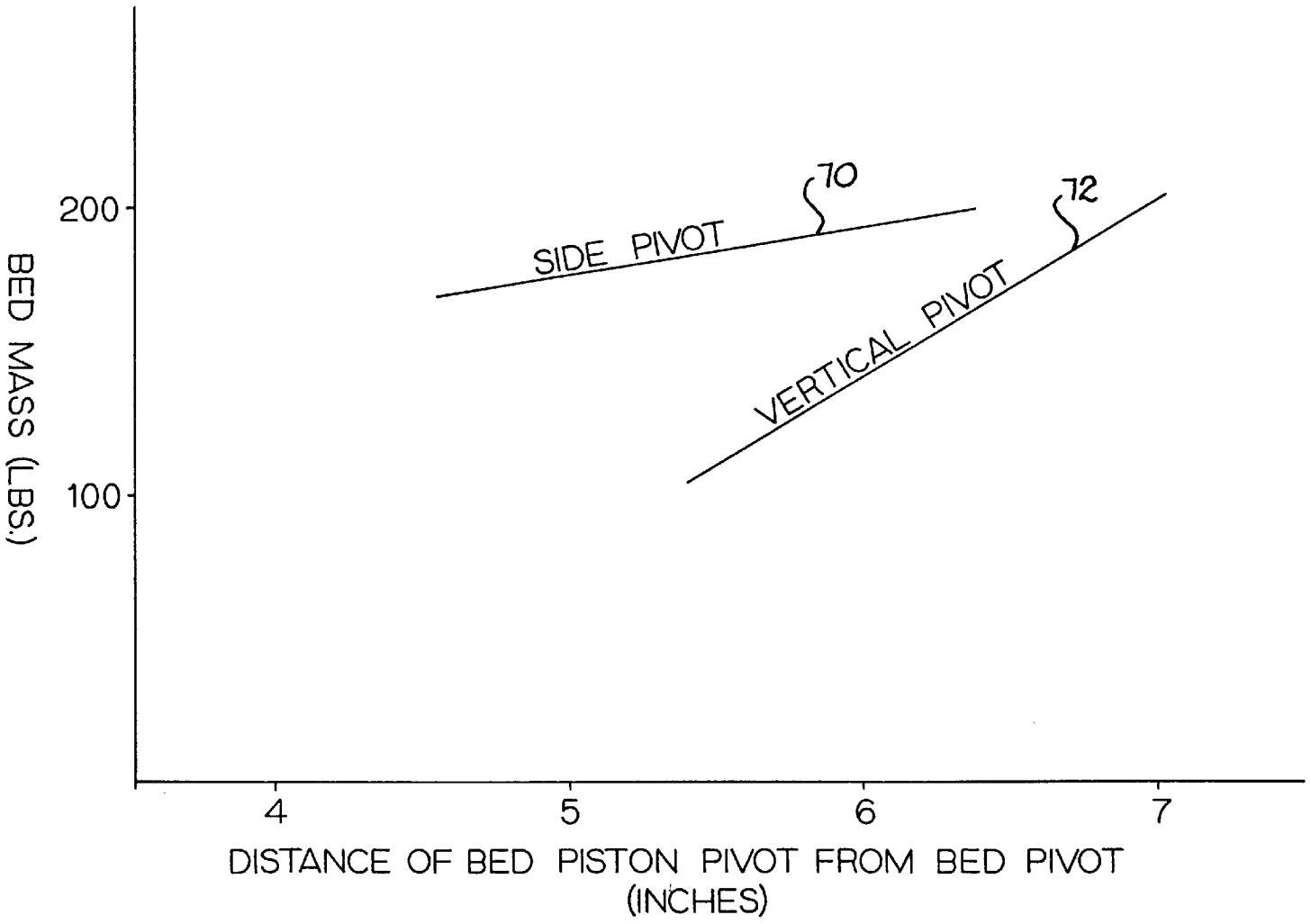
FIG. 9 is a graph showing the relationship between the frame/mattress/box spring mass and the distance between the pivot points of the ends of the piston attached to the cabinet frame and the bed frame.

Thus, the appropriate mounting arrangement is dictated by the mass of the bed 31 and may be selected based upon the magnitude of counterbalancing torque that is needed. The holes 40 and 46 may be calibrated and spaced at intervals that correspond to various weights of beds. For example, holes 40*a* and 46*a* may correspond to a standard bed using a plywood base, holes 40*b* and 46*b* to a standard bed using a particle wood base, and holes 40*c* and 46*c* to a double or queen bed using a ply wood base. The graph of FIG. 9 illustrates the relationship between the pivot point and the piston pivot for proper counterbalancing of the bed. It is preferred that pistons 50, have reserve stroke remaining no matter what the positioning of bed frame 14 in all mounting positions of the pistons 50. This prevents structural damage from occurring such as the pulling of the mounting brackets from position when the stroke of the pistons is exceeded by over rotation of the bed frame.

If desired, each of the holes 40 and 46 could coded to a different color printed, for example, as stripes 60 and 62 on the associated brackets adjacent the holes, allowing the user to determine which holes 40 and 46 should be selected for insertion of the mounting elements 42, 48. Each hole would have a stripe 60 or 62 that would correspond to a particular bed mass. For example, holes 40*a* and 46*a* may be coded with a green stripe 60 and 62 indicating the proper mounting arrangement for a standard bed with a plyboard base while holes 40*b* and 46*b* have a red code for a queen size bed with a plyboard base, i.e., a bed of a larger mass needing a greater counterbalancing torque. Using such a color code would greatly facilitate changing the mounting positions as the mass of the bed dictates changing the counterbalancing torque.

The graph of FIG. 9 depicts the relationship between the mass of the bed and frame that is pivoted and the distance from the bed piston end and the bed pivot point. For a given piston and bed pivot type, the relationship is essentially linear with the distance increasing with increasing mass of the bed frame and/or type of bed, e.g., twin, queen, full, etc. Side pivoted beds would have a different relationship than a side pivoted bed due to the shorter length from the center of mass of the side pivoted bed to the pivot axis. The graph shows two different lines with line 70 representing a typical side pivoted bed and line 72 the more common vertical pivoted bed. As stated above, the mass of the bed changes due to the type of material used for the frame and the type of bed in the frame.

From a reading of the above, it may be seen that the invention as described may benefit folding type of furniture and the like where the weight of the pivoted member may be varied. More particularly, the pivoting structure as described benefits beds of the folding type whether side or vertically pivoted. Using the description and appended drawing, those skilled in the art may modify and vary the described structure without departing from the spirit and scope of the attached claims.

I claim:

1. A folding furniture apparatus for selectively and alternatively moving between a substantially horizontal usable position and a substantially vertical storage position, comprising:

a support assembly;

a furniture component, said component being pivotally connected about a pivot axis to said support assembly for movement between said usable position and said storage position; and a counterbalancing system creating one of a selected value of torques about said pivot axis and biasing said furniture component to said vertical storage position;

wherein said counterbalancing system includes a biasing component for supplying a substantially constant force and mounting hardware for selectively positioning said biasing component relative to said pivot axis; and wherein said biasing component comprises at least one piston assembly, said piston assembly having one end connected to said support assembly by a first bracket and another end connected to said furniture component by a second bracket, said first and second brackets each having a plurality of holes adapted to removably receive a mounting element, said ends of the piston assembly having complimentary fittings at each end thereof for securing said ends to said mounting elements.

2. The apparatus of claim 1 in which the biasing component includes two piston assemblies acting on opposite sides of said furniture component, said piston assemblies being pivotally connected to said brackets at both ends thereof, said pivot connections of said piston assemblies to said brackets being movable to change the magnitude of the counterbalancing torque on said furniture component.

3. The apparatus of claim 2 in which said brackets are a pair of upper and lower brackets, said upper brackets being spaced apart and secured to said support assembly near said pivot axis and said lower brackets being spiced apart and secured to said furniture component, each of said lower brackets having a plurality of said holes aligned substantially horizontal at varying distances from said pivot axis and each of said upper brackets having said plurality of holes aligned substantially vertical when said furniture component is in the vertical position, each of said plurality of holes in said lower brackets having an associated hole in said upper brackets such that the distance between said lower bracket holes and said associated upper bracket holes are the same distance apart thereby permitting the use of the same piston assembly to be mounted between associated holes while varying counterbalancing torque values.

4. The apparatus of claim 3 wherein each of said holes in said lower bracket is coded with unique information identical to information coded on said upper bracket with respect to said associated holes.

5. A folding bed apparatus for selectively and alternatively moving a bed from a substantially vertical storage position to a substantially horizontal usable position, comprising:

a support assembly for housing said bed when in said storage position;

a bed frame for supporting a mattress and collectively defining said bed, said bed frame being pivotally connected about a pivot axis to said support assembly;

at least one lower mounting bracket mounted to said bed frame near said pivot axis and at least one upper mounting bracket mounted to said support assembly, said lower bracket having a plurality of first mounting points and said upper bracket having an associated plurality of second mounting points;

at least one counterbalancing piston for creating a torque acting on said bed frame toward said storage position, said counterbalancing piston being pivotally and removably connected at one end at a selected one of said mounting points on said lower mounting bracket and pivotally and removably connected at the other end at a mounting point of said upper bracket associated with said selected mounting point, thereby allowing said counterbalancing piston to be repositioned between said first mounting points and said associated second mounting points to vary the counterbalancing torque acting on said bed frame.

6. The apparatus of claim 5 wherein each of said holes in said lower bracket is coded with unique information corresponding to a value of torque needed to be exerted to counterbalance a predetermined weight of said bed, said associated holes being coded with identical information thereby permitting said counterbalancing piston to be repositioned in accordance with said unique information as the weight of said bed is changed.

* * * * *